US007083548B1

(12) United States Patent
Moore et al.

(10) Patent No.: US 7,083,548 B1
(45) Date of Patent: Aug. 1, 2006

(54) ISOMETRIC EXERCISE MOUTH TOOL

(76) Inventors: Michele S. Moore, 1109 E. Fifth St., Duluth, MN (US) 55805; Elizabeth A. Harvey, 1058 S. Moon Lake Dr., Eveleth, MN (US) 55734

( * ) Notice: Subject to any disclaimer, the term of this patent is extended or adjusted under 35 U.S.C. 154(b) by 298 days.

(21) Appl. No.: 10/222,053

(22) Filed: Aug. 16, 2002

(51) Int. Cl.
*A63B 23/03* (2006.01)
*A63B 21/002* (2006.01)

(52) U.S. Cl. ..... 482/11; 482/91

(58) Field of Classification Search ..... 482/10–11, 482/91; 606/234–235
See application file for complete search history.

(56) References Cited

U.S. PATENT DOCUMENTS

| | | | | |
|---|---|---|---|---|
| 2,680,967 | A * | 6/1954 | Newman | 73/379.01 |
| 3,118,667 | A * | 1/1964 | Barons | 482/11 |
| 3,528,655 | A | 9/1970 | Ruderian | 272/82 |
| 3,938,508 | A | 2/1976 | Buckner | 128/76 |
| 4,196,902 | A | 4/1980 | Borriello | 272/95 |
| 4,280,696 | A | 7/1981 | Ramon | 272/95 |
| 4,945,918 | A * | 8/1990 | Abernathy | 600/532 |
| 5,092,013 | A * | 3/1992 | Genovese, Jr. | 15/104.94 |
| 5,213,553 | A * | 5/1993 | Light | 482/11 |
| 5,263,976 | A * | 11/1993 | Williams | 606/235 |
| 5,735,772 | A * | 4/1998 | Schiavoni | 482/11 |
| 5,958,150 | A * | 9/1999 | Borger et al. | 134/42 |
| 6,406,404 | B1 | 6/2002 | Chu | 482/11 |
| 6,524,225 | B1 * | 2/2003 | Arias | 482/11 |
| 6,607,549 | B1 * | 8/2003 | Huang | 606/234 |

* cited by examiner

*Primary Examiner*—Jerome Donnelly
*Assistant Examiner*—Fenn C. Mathew
(74) *Attorney, Agent, or Firm*—Nikolai & Mersereau, P.A.

(57) ABSTRACT

A soft, flexible, pliable one-piece isometric exercise mouth tool for conditioning facial muscles to be used for cosmetic and medical purposes. The isometric exercise mouth tool has a hollow body portion and a stem or handle for holding the body portion in the desired position. The body portion has ridges for positioning the lips thereon for various exercises. The exercises are performed by sucking on or compressing the body of the isometric exercise mouth tool or a combination thereof to exercise the muscles in the mouth, face and throat.

4 Claims, 3 Drawing Sheets

ISOMETRIC EXERCISE MOUTH TOOL

BACKGROUND OF INVENTION

1. Field of Invention

This invention relates to exercising the mouth, cheek, chin and tongue muscles, specifically isometric exercises that are performed with a mouth tool.

2. Description of the Related Art

Several types of exercise mouth devices for strengthening facial muscles. These devices generally comprise a plurality of parts which are adjustable and have springs or attachments making the device complex, bulky and uncomfortable and are difficult or costly to assemble.

U.S. Pat. No. 6,406,404, Chia Chen Chu issued Jun. 18, 2002. It is an assembly of several parts including a spring and is used for exercising the lips of a user. The design is clumsy for the user to put in the mouth. Finally his device is difficult to clean.

U.S. Pat. No. 3,528,655, Ruderian issued Sep. 15, 1970, is a combination of several parts which must be assembled and is limited to exercising the cheeks of the user.

U.S. Pat. No. 3,938,508, Buckner issued Feb. 17, 1976. It has several parts which are adjustable and is used to prevent shrinkage of the tissues around the patient's mouth or to enlarge or progressively widen the mouth.

U.S. Pat. No. 4,196,902 Borriello issued Apr. 8, 1980, is a crescent shaped device for preventing wrinkles by exercising facial muscles. The crescent is kept between the teeth and carrying out normal mastication.

U.S. Pat. No. 4,280,696 Ramon issued Jul. 28, 1981. It has a pair of flat spring arms connected to a torque spring and a pair of teeth engaging platforms for opposing mastication motion of the jaws.

All the above exercise mouth devices are for one exercise only. Some of the devices have multiple parts, which increases the cost of manufacture. Other devices have attachments, which must be assembled. The multiple pieces make the device difficult to clean for reuse. Some of the devices are heavy, bulky and messy to use.

SUMMARY

The isometric exercise mouth tool comprises a barrel shaped body having a hollow cavity and a stem to grip the tool while exercising. The isometric exercise mouth tool can be used for a multiplicity of exercises in a number of positions in the mouth. The stem allows the user to position device in different positions for exercising different muscles. Also, the user can suck into the hollow cavity of the barrel for conditioning the tongue muscle and for smooth smoothing the cheeks.

The isometric mouth tool is made of flexible and durable clear silicone and is capable of repeated use without damage. It is easy to clean and allows the user to close their lips around the stem during many exercises to prevent saliva from escaping. Further during some exercises saliva may be collected in the barrel during use and disposed when the exercise is completed.

OBJECTS OF THE INVENTION

It is an object of the invention to provide an exercise mouth tool, which is very lightweight.

It is an object of the invention to provide an exercise mouth tool, which is durable.

It is an object of the invention to provide an exercise mouth tool, which is time saving and easy to travel with.

It is an object of the invention to provide an exercise mouth tool, which can be easily cleaned and sterilized.

It is an object of the invention to provide an exercise mouth tool that is easy and simple to use.

It is an object of the invention to provide an exercise mouth tool that is very comfortable with a natural feeling.

It is an object of the invention to provide an exercise mouth tool that conditions many facial muscles.

It is an object of the invention to provide an exercise mouth tool that will enhance beauty and raise self esteem.

It is an object of the invention to provide an exercise mouth tool, which strengthens not only the lips and mouth but also the cheeks, chin, throat and the tongue muscles.

It is an object of the invention to provide an exercise mouth tool to improve muscle condition.

It is an object of the invention to provide an exercise mouth tool with variable sizes, the smaller the tool the more contraction and the shorter the muscle length contention.

It is an object of the invention to provide an exercise mouth tool that is very flexible and durable.

It is an object of the invention to provide an exercise mouth tool with low production and manufacturing costs.

It is an object of the invention to provide an exercise mouth tool to condition muscles which enhance the user's appearance.

It is an object of the invention to provide an exercise mouth tool to exercise facial muscles for these face conditions: Bell's palsy, pre-op and post-op oral surgery, speech pathology, burn patients, cerebral palsy, muscular dystrophy, mouth cancer, Parkinson's disease, multiple sclerosis, Guillain-Barre', and for stroke victims.

It is an object of the invention to provide an exercise mouth tool for any disease which causes muscle atrophy.

It is an object of the invention to provide an exercise mouth tool for improving abilities of mastication, speech and swallowing: dysphagia, rehabilitation, facial tension, pediatrics, adults, headaches, hyiod-strengthens muscles for swallowing, sinus problems and tongue strengthening.

It is an object of the invention to provide an exercise mouth tool for dental or oral problems involving the muscles.

It is an object of the invention to produce big kissable lips.

Other objects, advantages and novel features of the present invention will become apparent from the following description of the preferred embodiments when considered in conjunction with the accompanying drawings.

DETAILED DESCRIPTION OF THE PREFERRED EMBODIMENT

The isometric exercise mouth tool 50 consists of a flexible and durable material which can be repeatedly pressed, twisted and pushed against. The material must also withstand wetness from saliva. In the preferred embodiment, the base is flexible plastic such as clear medical silicone, available from Dow Corning. 91331 Bradley Ave., Bacinma, Calif. However, the isometric exercise mouth tool 50 can also consist of other materials such as a vinyl, rubber or other plastic substance. The material should be washable and durable so that the isometric exercise mouth tool 50 can be reused.

Figure 1:
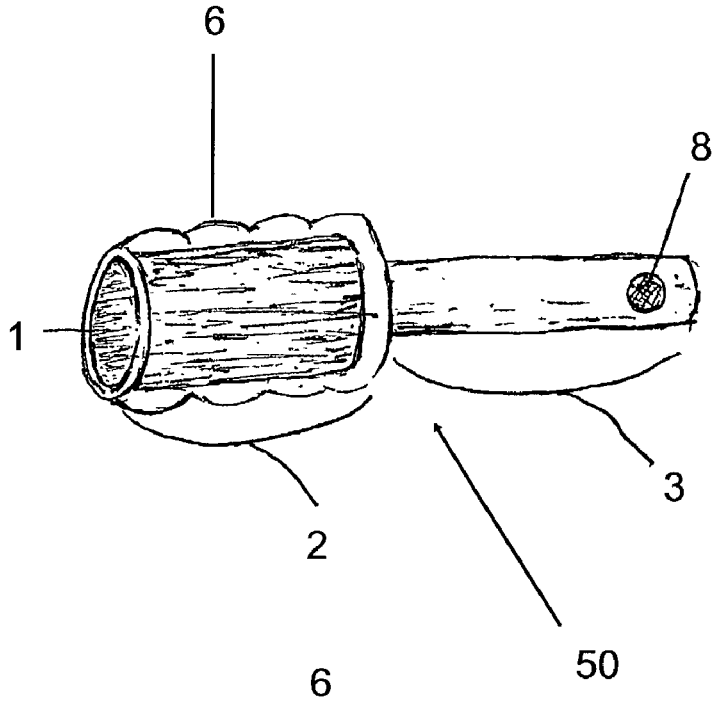
FIG. 1 shows a cut away side perspective view of the isometric exercise mouth tool.
Figure 2:
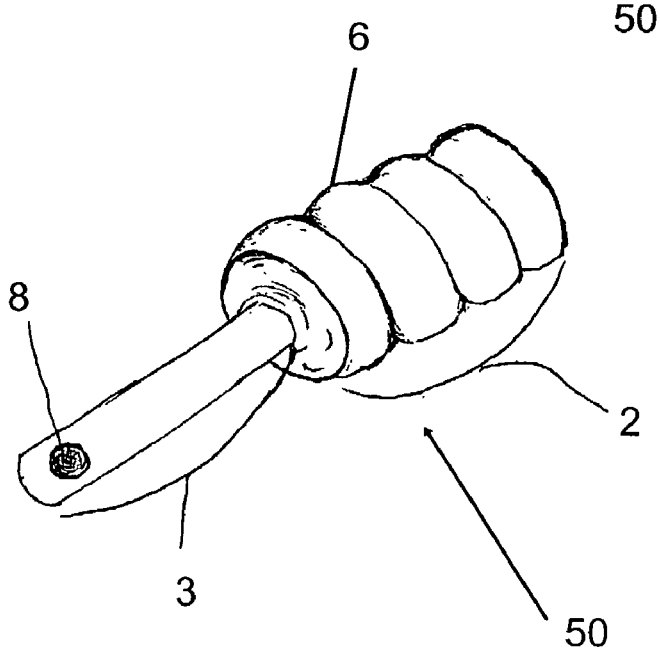
FIG. 2 shows an end perspective view at the isometric exercise mouth tool.
Figure 3:
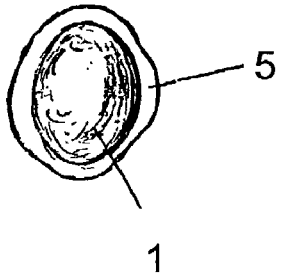
FIG. 3 shows a top view of the isometric exercise mouth tool.
Figure 4:
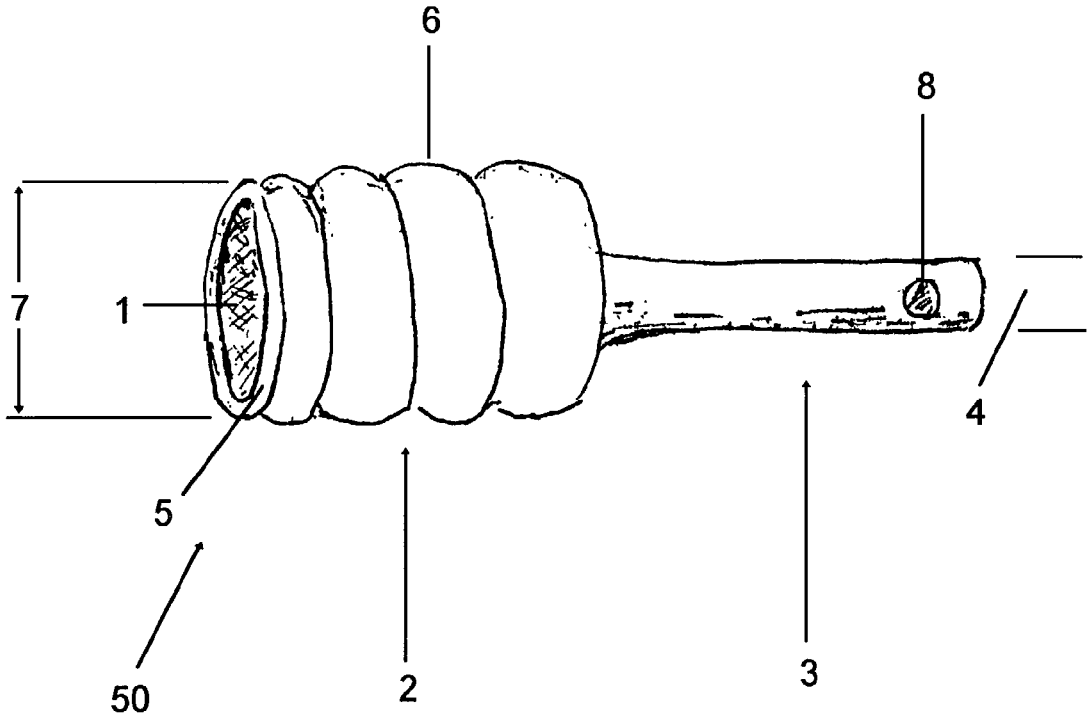
FIG. 4 shows the large size of the isometric exercise mouth tool.

The isometric exercise mouth tool 50 comprises a hollow body or barrel 2 and a stem or handle 3 preferably made from one continuous piece of material. In FIG. 1 the hollow body 2 of the isometric exercise mouth tool 50 has a curved rolling ridged portion with ridges 6 on the exterior. The curved rolling ridges 6 on hollow body 2 can be grasped by wrapping the lips of the user around the hollow body 2 and then sucking and or pressing to allow resistance and exercise various muscles.

The isometric exercise mouth tool 50 has an aperture 1 at one end for suction which helps build tongue and cheek muscles by pressing the user's lips on the ridges 6 and sucking in on the hollow body 2. The hollow body 2 also serves to collect saliva during exercising.

The isometric exercise mouth tool 50 has a stem 3 for grasping and a firmly holding and positioning the hollow body 2 during the exercise process.

The isometric exercise mouth tool 50 preferably comes in different sizes for different exercises and for different sized mouths. While any sizes can be manufactured the following are three combinations of dimensions.

A large size having a 38 mm long body 2, a 32 mm long stem 3, a 3 mm thickness of body wall 5, a 25 mm diameter of the body 7, and a 6 mm stem thickness 4.

A medium size having a 28 mm long body 2, a 32 mm long stem 3, a 3 mm thickness of body wall 5, a 22 mm diameter of the body 7, and a 6 mm stem thickness 4.

A small size having a 13 mm long body 2, a 32 mm long stem 3, a 3 mm thickness of body wall 5, a 19 mm diameter of the body 7, and a 9 mm stem thickness 4.

The stem 3 may have finger gripping portions or have a ergonomic shape for holding the stem with a hand. The stem 3 may also have an aperture 8 therethrough for hanging the stem 3 on a hook or for passing a string therethrough.

Figure 5:
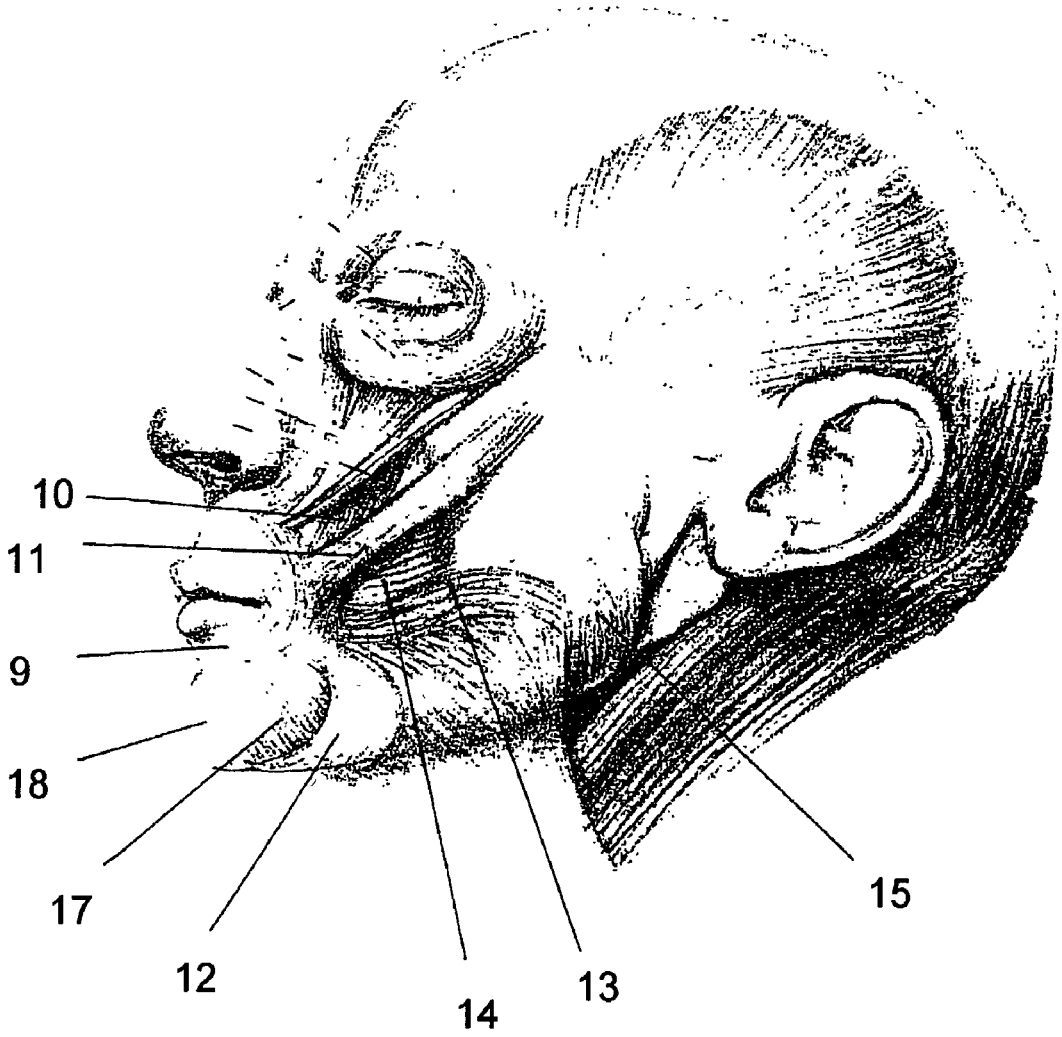
FIG. 5 shows some of the muscles that can be exercised with the isometric exercise mouth tool.

The isometric exercise mouth tool 50 can be moved to various positions such that the user's lips engage different ridges 6 on the body 2 of the isometric exercise mouth tool 50. The user can also manipulate the stem 3 such that the body 2 is at any desired position in the mouth for exercising different muscles in the mouth, neck, throat, checks or lips. FIG. 5 shows some of the muscles which can be exercised with the isometric exercise mouth tool 50 by using the tool as indicated.

In all methods of exercising the isometric exercise mouth tool 50 is placed in the mouth and in front of the teeth which are clenched together. Holding the stem 3 with the thumb and forefinger then pressing gently and wrapping the lips around the ridges 6 on the hollow body 2, and suck on the curved rolling ridged 6 body 2 and hold for five seconds. Then lift the lips up and bring them as far toward the stem 3 as possible, then again press down and suck in on the curved rolling ridges 6 of the body 2 and hold for five more seconds. Once again repeat back and forth for 10 minutes. The exercises should be practiced two times a day, once in the morning and once in the evening for the best results. To exercise some of the muscles the head should be tilted backward. Sucking on the body 2 in various positions work the all of the following muscles.

The Orbicularis ons muscle 9 which encircles the mouth.

The levator angulioris and levator labii superioris muscles 10 in the cheek.

The zygomaticus major/minor muscles 11 located in the angle of the mouth.

The depressor anguli oris muscle 12 located in the angle of the mouth.

The risorius muscle 13 in the angle of the mouth.

The buccinator—these fibers 14 run to the angle of the mouth.

The masseter muscle 15 at the lower edge of the outer jaw.

The gerioglossus (not visible in FIG. 5) is the tongue muscle, located in the mouth interior.

The depressor labii inferioris-origin 17 at the base of the mandible.

The mentalis 18 is a short muscle originating below each of the incisor teeth of the mandible.

Although the body 2 is shown hollow a solid body may be used. Further although the body is shown with ridges a smooth body may be used.

Obviously, many modifications and variations of the present invention are possible in light of the above teachings. It is therefore to be understood that, within the scope of the appended claims, the invention may be practiced otherwise than as specifically described.

What is claimed is:

1. A method of exercising muscles around the mouth of the user comprising the steps of:

obtaining an isometric exercise tool having an open ended resiliently compressible cylindrical hollow body portion having an undulating ridged outside wall, a first circumference inside diameter and a base, wherein the open end of the hollow body portion with the undulating ridged outside wall is for placement in the user's mouth, a solid handle portion having a second outside circumference substantially smaller than the first circumference, the handle being integrally attached to a closed end of the base, the circumferences being essentially coaxial, placing the isometric exercise mouth tool body portion in the mouth of the user, placing the isometric exercise mouth tool body portion against the muscle to be exercised, holding the isometric exercise mouth tool body portion in place by use of a handle attached thereto, pushing against the body portion of the isometric exercise mouth tool using the muscle to be exercised.

2. A method of exercising muscles around the mouth of the user as in claim 1 further comprising the step of, compressing the body portion of the isometric exercise mouth tool by the muscle to be exercised.

3. A method of exercising muscles around the mouth of the user as in claim 1 further comprising the step of, placing and holding the lips of the user on ridges on the body portion of the isometric exercise.

4. A method of exercising muscles around the mouth of the user as in claim 1 further comprising the step of, sucking on the body portion of the isometric exercise mouth tool.

* * * * *